US007863547B2

(12) United States Patent
Drozd et al.

(10) Patent No.: US 7,863,547 B2
(45) Date of Patent: Jan. 4, 2011

(54) MICROWAVE CHAMBER

(75) Inventors: Esther Drozd, Cary, NC (US); J. Michael Drozd, Raleigh, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 1196 days.

(21) Appl. No.: 10/597,426

(22) PCT Filed: Jan. 31, 2005

(86) PCT No.: PCT/US2005/002767

§ 371 (c)(1),
(2), (4) Date: Jul. 25, 2006

(87) PCT Pub. No.: WO2005/079117

PCT Pub. Date: Aug. 25, 2005

(65) Prior Publication Data

US 2008/0237224 A1 Oct. 2, 2008

Related U.S. Application Data

(60) Provisional application No. 60/521,003, filed on Feb. 3, 2004.

(51) Int. Cl.
*H05B 6/70* (2006.01)

(52) U.S. Cl. ..... 219/691; 219/693; 315/248

(58) Field of Classification Search ..... 219/690, 219/691, 746, 748, 751; 315/111.21, 248; 438/770; 118/723 AN, 723 MW, 723 MP; 204/298.38

See application file for complete search history.

(56) References Cited

U.S. PATENT DOCUMENTS

| | | | | | |
|---|---|---|---|---|---|
| 3,673,370 | A | * | 6/1972 | Johnson | 219/693 |
| 3,775,709 | A | * | 11/1973 | Firmain et al. | 333/252 |
| 4,566,012 | A | * | 1/1986 | Choung et al. | 342/359 |
| 4,749,915 | A | * | 6/1988 | Lynch et al. | 315/248 |
| 5,990,466 | A | * | 11/1999 | McKee et al. | 219/746 |
| 6,008,483 | A | * | 12/1999 | McKee et al. | 219/746 |
| 2003/0205574 | A1 | | 11/2003 | Risman et al. | |
| 2004/0104221 | A1 | | 6/2004 | Kono et al. | |
| 2004/0238533 | A1 | | 12/2004 | Alton et al. | |
| 2006/0196871 | A1 | | 9/2006 | Risman et al. | |

* cited by examiner

*Primary Examiner*—Quang T Van
(74) *Attorney, Agent, or Firm*—James T. Cronvich

(57) ABSTRACT

Microwave apparatus for exposing materials on an elongated member, such as a mandrel, to microwave energy. The apparatus includes a cylindrical microwave exposure chamber (10). Elongated slots (20) spaced about the circumference of the chamber (10) are in communication with openings (50) in the walls of waveguides (28) attached to the exterior (19) of the chamber. Microwave energy fed into the waveguide (28) is coupled into the chamber (10) through the associated openings (50) and slots (20). Bars (54) spaced apart in the direction of wave propagation span the opening (50) in the waveguide for uniform or customized delivery of microwave energy into the chamber (10). A low-profile mode stirrer (38) at the rear end of the chamber further evens out the energy distribution. A front plate (62) seals to the chamber and supports a rotatable mandrel (60) on which material to be exposed to microwave energy in the chamber (10) is wrapped.

22 Claims, 7 Drawing Sheets

MICROWAVE CHAMBER

BACKGROUND

This invention relates generally to microwave heating and, more particularly, to heating materials in a cylindrical microwave chamber.

Many industrial processes require that materials be heated. Microwave energy is used in many of these processes to cook, dry, sterilize, or cure a variety of materials. In many applications, it is important that the material be heated uniformly. In some cases, the material is wrapped around a fixture, such as a metal mandrel. But the introduction of metal into a microwave exposure chamber can cause arcing and make the electromagnetic field difficult to control. Arcing can cause damage to both the material being processed and the processing equipment. And without good control of the electromagnetic field, the material may not be heated uniformly or efficiently. Consequently, there is a need for a microwave heating apparatus that can efficiently and uniformly heat materials without arcing.

SUMMARY

These and other needs are satisfied by a heating apparatus embodying features of the invention. The apparatus comprises a cylindrical wall that extends axially from a first end to a second end. The wall includes an interior surface and an exterior surface. A slot is formed in the wall. An end plate closes off the second end of the wall to form a cylindrical chamber. The apparatus also includes a waveguide. The waveguide forms an opening along its length. The waveguide connects to the cylindrical chamber with the opening in communication with the slot. The waveguide couples microwave energy into the cylindrical chamber through the opening and the slot.

In another aspect of the invention, a waveguide comprises two opposite first walls connected to two opposite second walls to form a length of rectangular waveguide extending in the direction of microwave propagation. An opening is formed in one of the first walls along a portion of the length of the waveguide. Bars extend across the opening. The bars are spaced apart along the length of the waveguide. The waveguide is attachable to a microwave chamber with the opening in communication with a slot in the microwave chamber. The waveguide couples microwave energy through the opening and the slot into the microwave chamber.

In another aspect of the invention, a waveguide forms a pattern of alternating metallic members and gaps in one of the walls of the wave guide. The metallic members are spaced apart in the direction of microwave propagation along the waveguide. The waveguide is attachable to a microwave chamber with the gaps in communication with a slot in the microwave chamber to release microwave energy through the gaps and the slot into the microwave chamber in a preselected manner determined by the pattern of alternating metallic members and gaps.

In yet another aspect of the invention, a mode stirrer for a cylindrical microwave exposure chamber comprises a rotatable shaft defining an axis of rotation. Sector-shaped blades are attached to the shaft. The blades lie in parallel planes normal to the axis of rotation.

BRIEF DESCRIPTION OF THE DRAWINGS

These features and aspects of the invention, as well as its advantages, are better understood by reference to the following description, appended claims, and accompanying drawings, in which:

DETAILED DESCRIPTION

Figure 1:
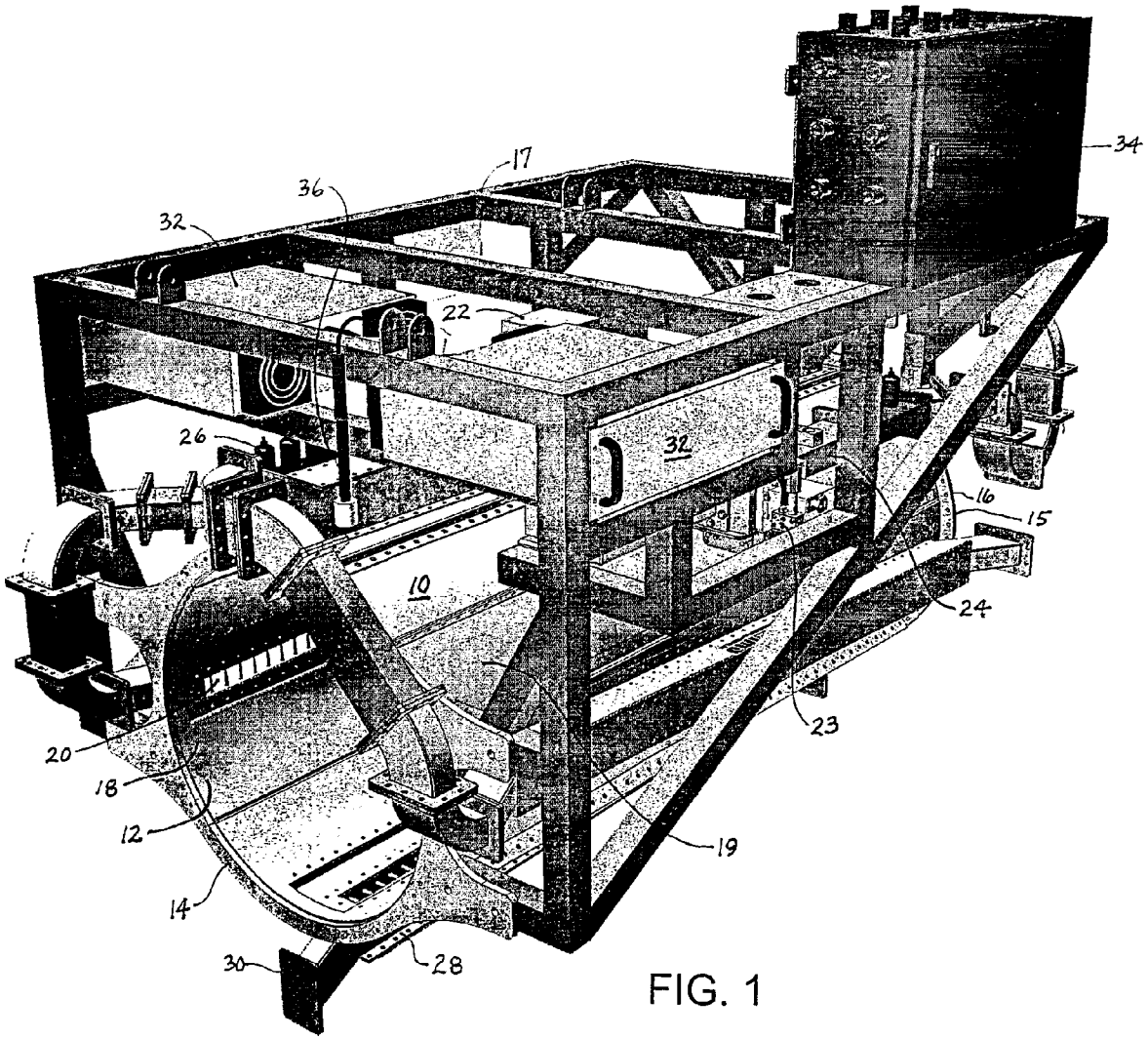
FIG. 1 is a front perspective view of a microwave exposure chamber embodying features of the invention.
Figure 2:
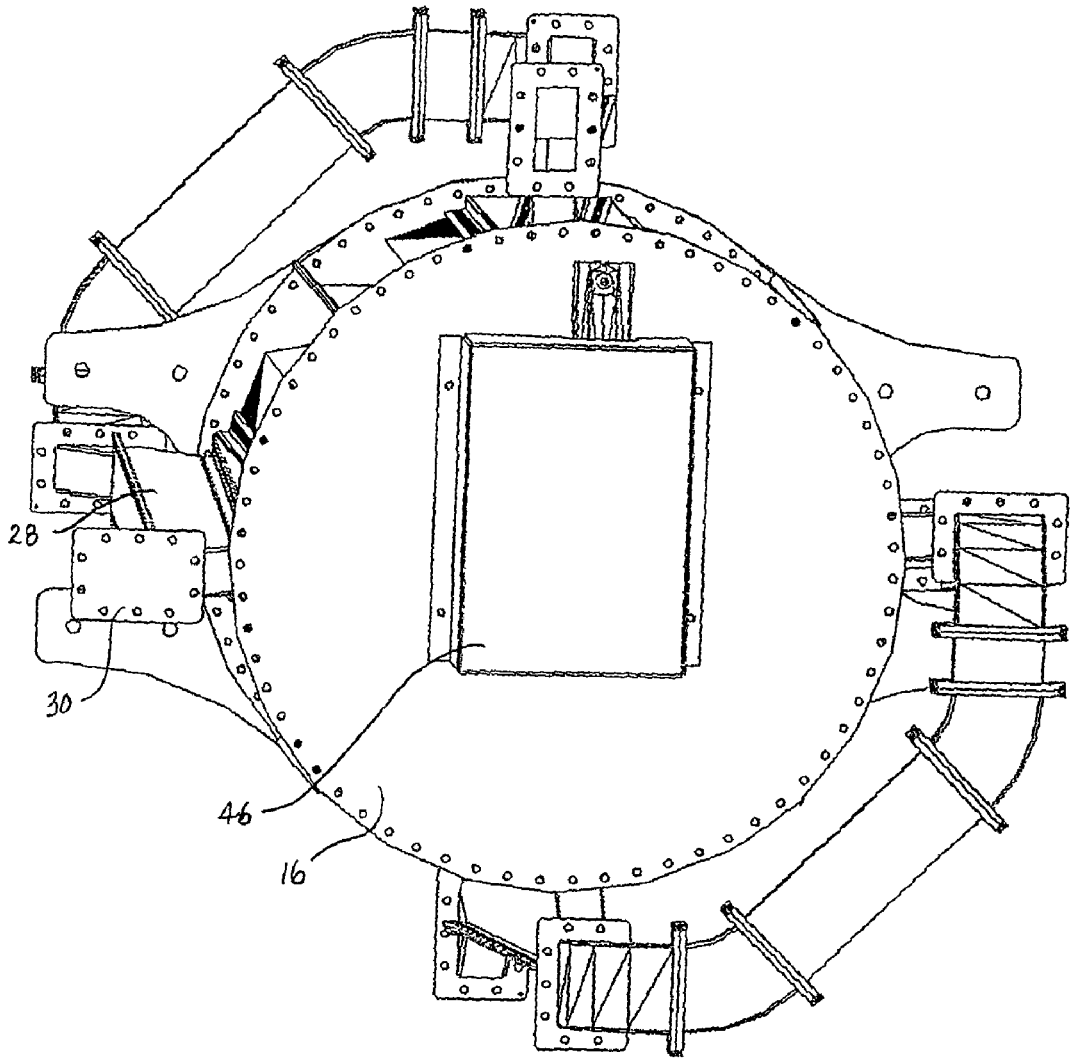
FIG. 2 is a rear perspective view of the microwave exposure chamber of FIG. 1.

A microwave exposure apparatus embodying features of the invention is shown in FIGS. 1 and 2. The apparatus includes a microwave exposure chamber 10 having a cylindrical wall 12 that extends from a first entrance end 14 to a blind second end 15 closed with an end plate 16. A framework 17 supports the chamber and associated components. The cylindrical wall has an interior surface 18 and an exterior surface 19. Elongated slots 20 are formed in the wall preferably at diametrically opposed positions. In this version, four slots are shown spaced about the circumference of the cylindrical chamber every 90°. Fewer or more slots could be used, but, in the case of multiple slots, the slots are preferably spaced circumferentially at least three wavelengths. Microwave energy is coupled into the chamber through the slots.

In this version, magnetrons 22 are used as microwave energy sources. In this example, the magnetrons operate at 2.45 GHz and 6 kW, although other frequencies and power levels are possible depending on the application. Each magnetron is connected to an independent waveguide 24. A circulator 23 is connected to the magnetron to protect it from damage. A tuning section 26 in the waveguide is used to tune the magnetron to the load. The rectangular waveguide is dimensioned to support a $TE_{10}$-mode electromagnetic wave. The microwave energy propagates down the waveguides and is coupled into the chamber through two slots. Each waveguide includes a pair of leaky bar structures 28 that launch microwave energy into the chamber through the slots 20. The structures are connected in series, with the generator end of each at opposite ends of the chamber. The waveguide terminates in a shorting plate 30 for increased efficiency.

The magnetrons are powered by power supplies 32. A controller 34 controls the power supplies and monitors system operating conditions. For example, an electromagnetic radiation leak detector 36 connects to the controller, which monitors the detector's output to indicate the radiation level.

Figure 3:
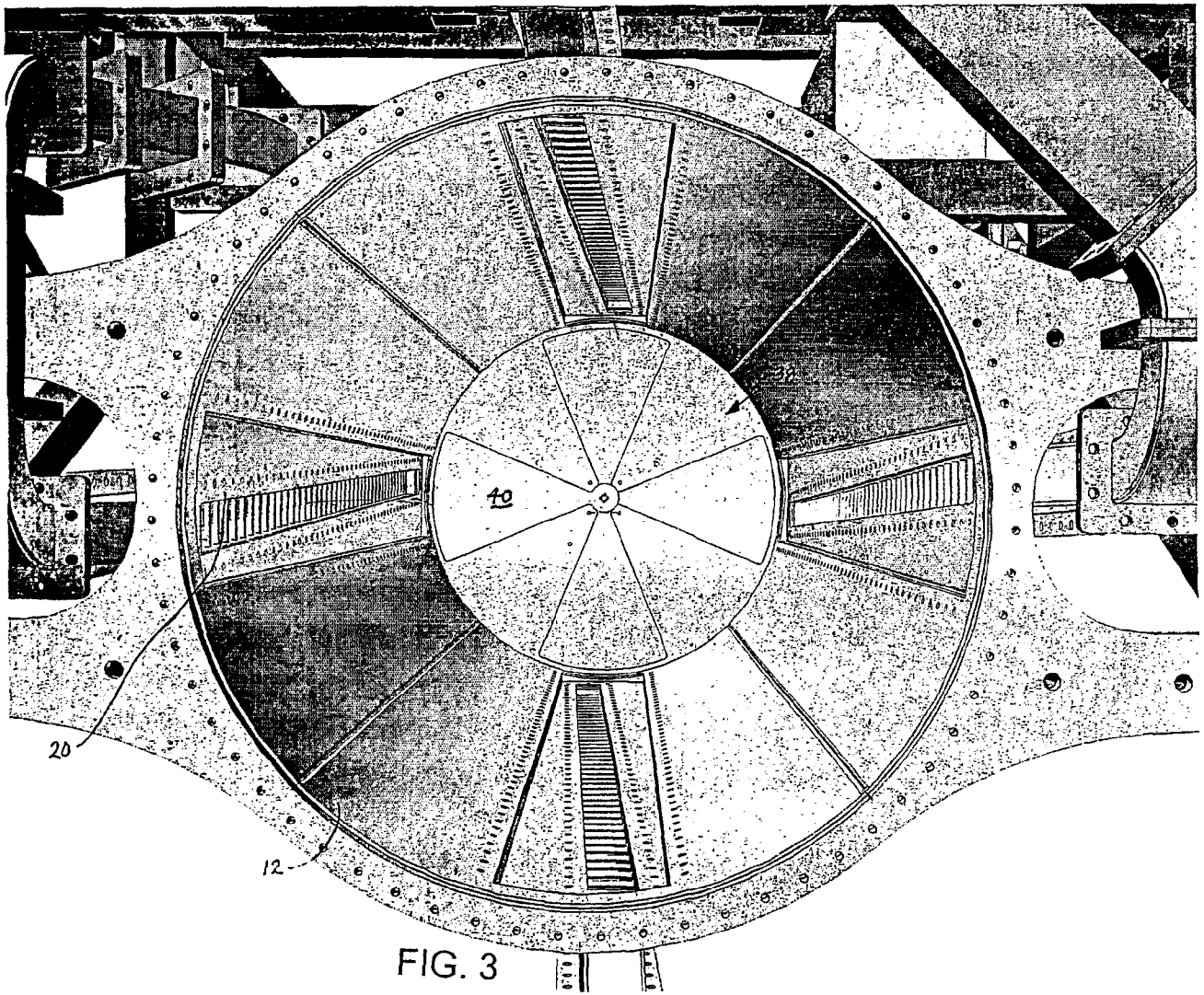
FIG. 3 is a perspective view of the microwave exposure chamber of FIG. 1 looking axially into the chamber.

The inside of the microwave chamber is shown in FIG. 3. The slots 20 in the wall 12 of the chamber extend generally along the length of the chamber. Although the slots could be arranged parallel to the axis of the cylindrical chamber, they are preferably arranged oblique to the axial direction. This oblique orientation helps distribute energy throughout the cavity.

Figure 4:
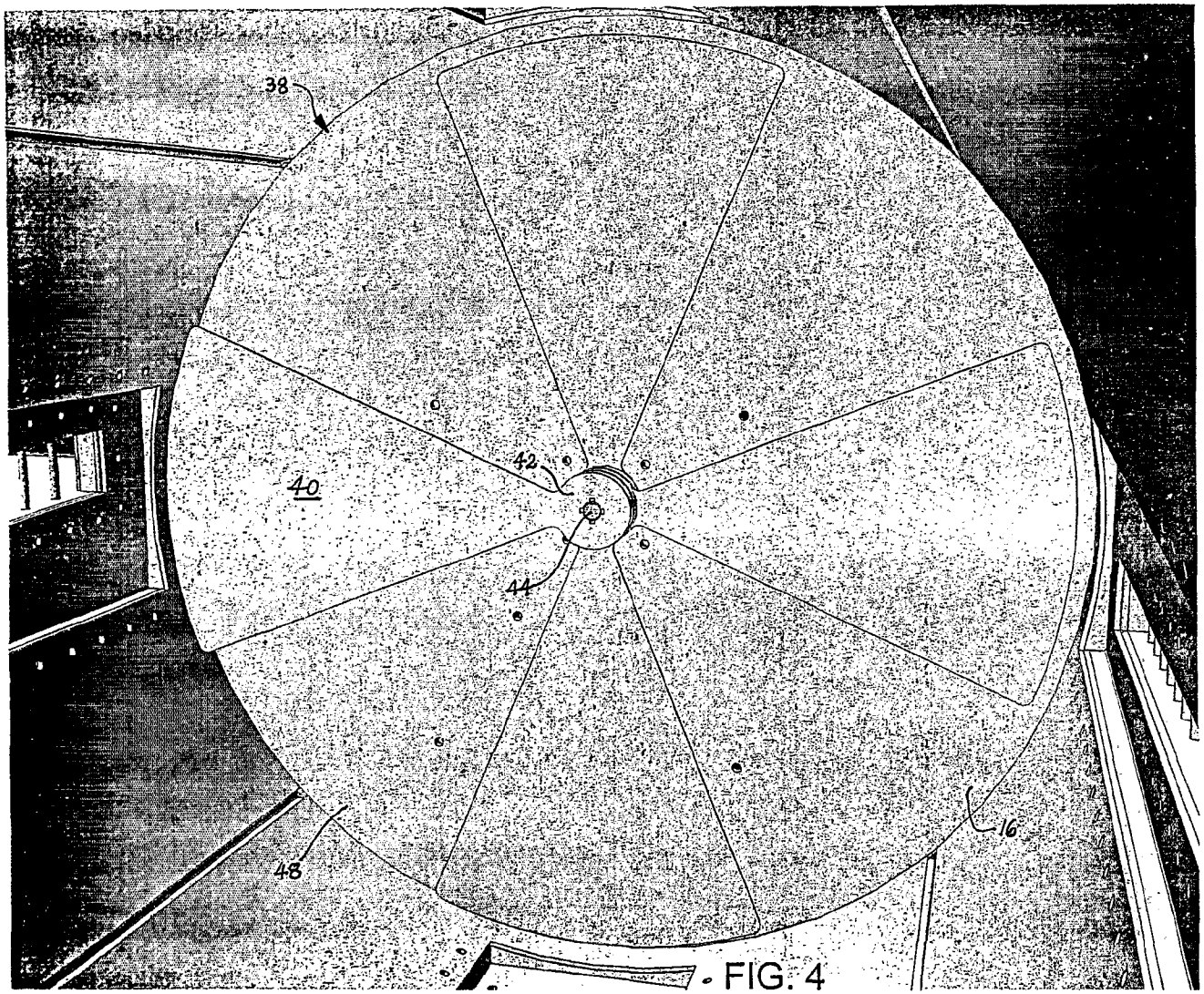
FIG. 4 is a perspective view of the mode stirrer used with the microwave exposure chamber of FIG. 1.

A mode stirrer 38 (FIG. 4) resides in the chamber at the blind second end. The mode stirrer has four sector-shaped blades 40, each extending outward from a hub 42. A bore in the hub receives a rotating drive shaft 44 that rotates the blades. The drive shaft extends through a bearing in the end plate 16 into a motor (not shown) in a rear housing 46. The four blades shown in the example lie in different parallel planes axially offset from consecutive blades by their thickness. The planes of the stacked blades are parallel to the end plate and normal to the axis of the drive shaft. Preferably, the planes of the blades are offset by at least one-quarter wavelength. The blades are also spaced apart from each other circumferentially across large inter-blade gaps 48 to prevent arcing between blades. Thus, the sum of the sectors spanned by all the blades is less than 360°. The offset planar structure of the mode stirrer also takes up less space than a mode stirrer with angled blades. The low-profile mode stirrer is effective in making the radiation exposure more uniform over time. In this example, the stirrer rotates at about 10 rev/min.

Figure 5:
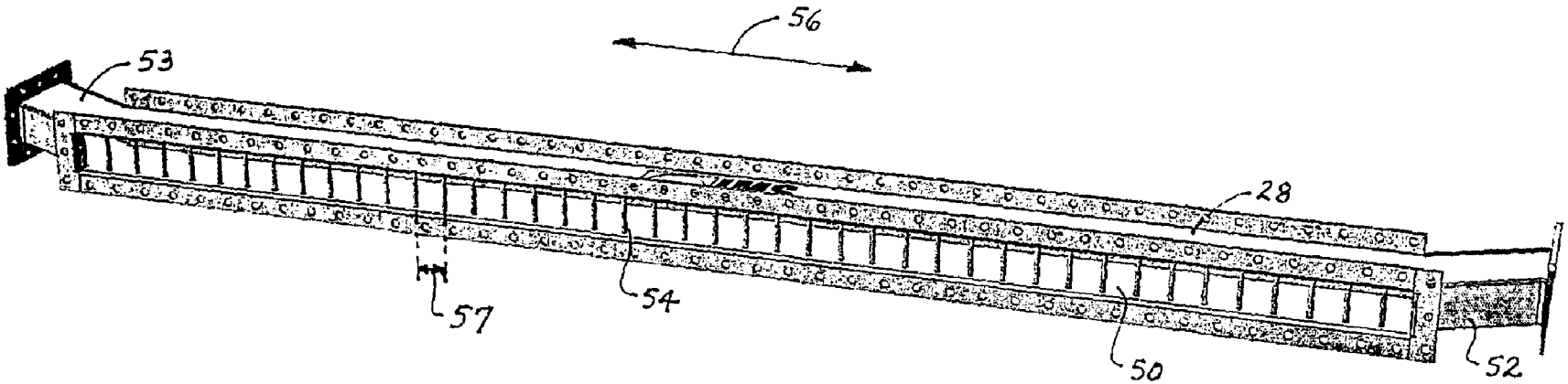
FIG. 5 is a perspective view of a length of waveguide used with the microwave exposure chamber of FIG. 1.
Figure 6:
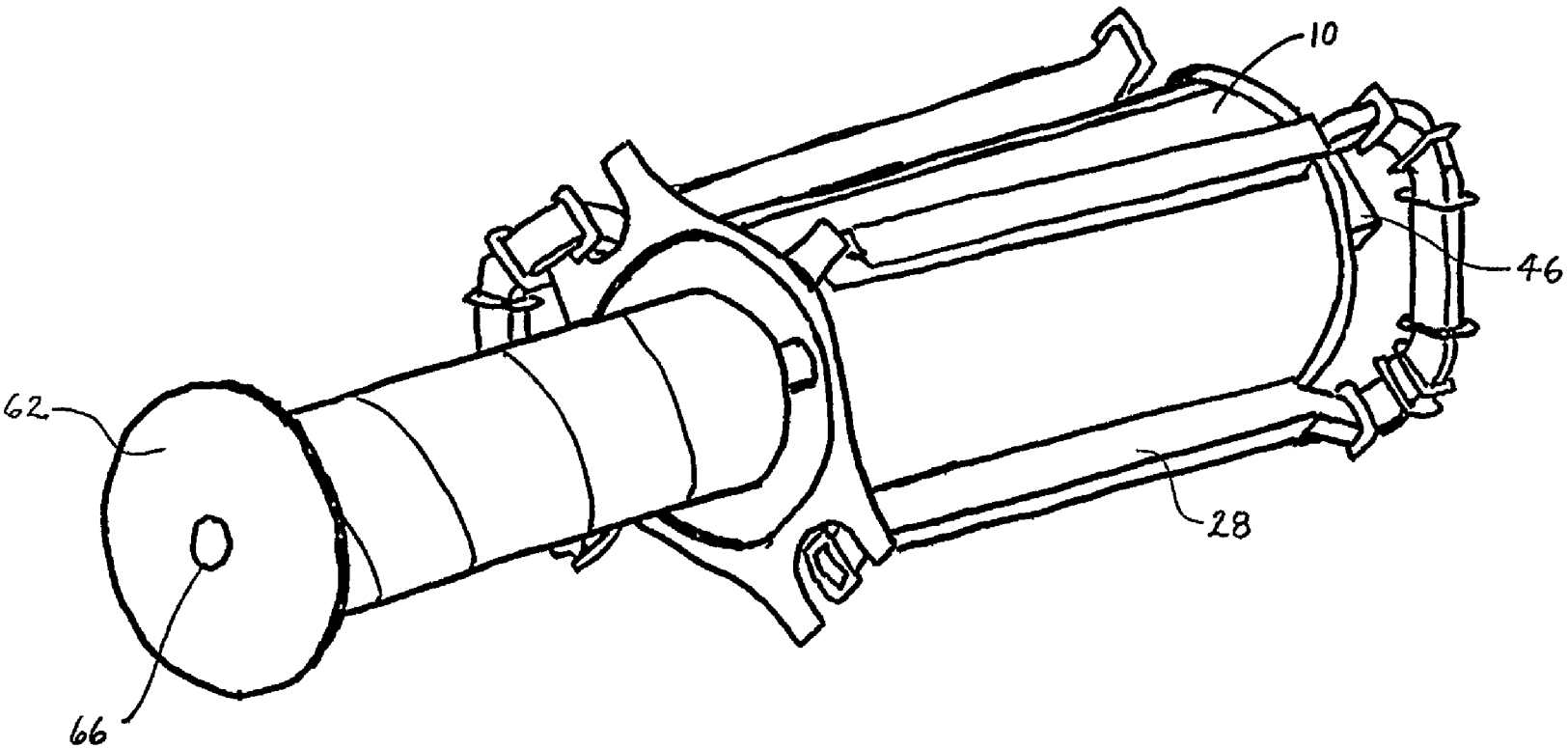
FIG. 6 is an exploded view of the microwave chamber of FIG. 1 and material on a mandrel through the front plate.

The leaky bar waveguide 28 is shown alone in FIG. 5. The waveguide includes an opening 50 along its width. The opening is preferably in one of two narrow walls 52 of the waveguide for a more gradual release of energy into the chamber. The narrow walls are connected by broad walls 53 to form a rectangular waveguide. (The opening could be formed in the broad walls instead.) Metallic members, in the form of bars 54, spaced apart in the direction of primary wave propagation 56, extend across the opening in this example. The bars are preferably cylindrical (without sharp edges) to reduce arcing. The bars are uniformly spaced at constant intervals 57 along the direction of propagation and form a pattern of alternating bars and gaps. But the intervals can be varied from one to the next in a different preselected pattern to adjust the distribution of energy in the chamber depending on the application. For the power levels and operating frequency of this example, the center-to-center spacing of the uniformly spaced bars is on the order of about 3 cm. This spacing prevents arcing and ensures the gradual release of energy into the cavity. The waveguides are attached to the exterior wall 19 of the chamber with the openings in communication with the slots in the chamber wall. Microwave energy in the waveguide is coupled into the chamber through the openings and the associated slots. The bars serve to make the coupling of energy into the chamber more gradual and uniform. Like the oblique slots, the leaky bar waveguides are disposed at an angle relative to the axis of the chamber.

Figure 7:
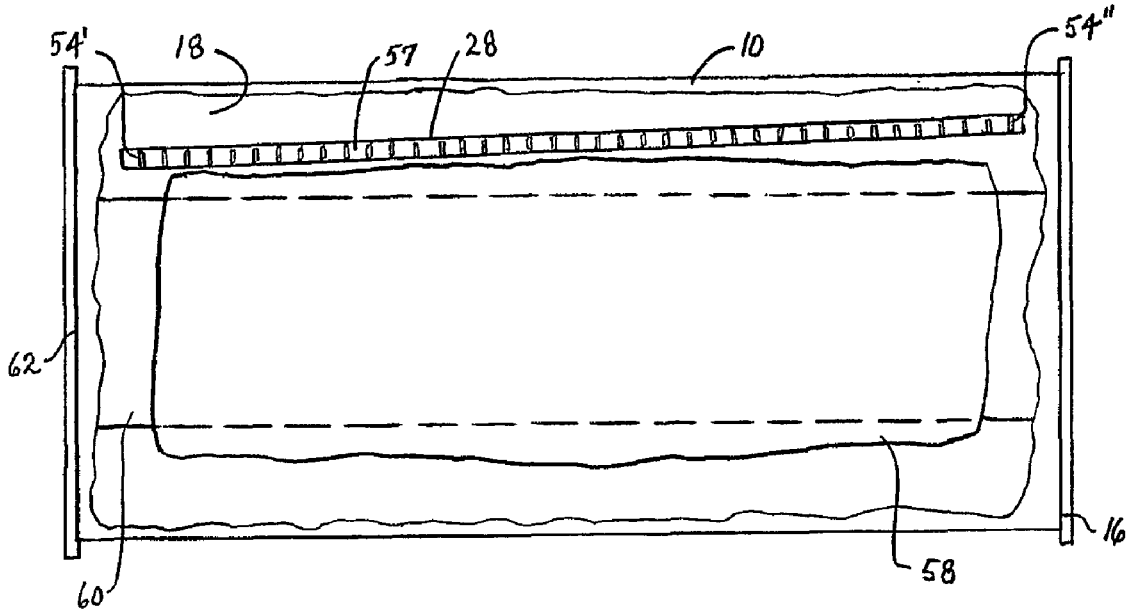
FIG. 7 is a cutaway side view of the microwave chamber of FIG. 1 with the mandrel inserted.
Figure 8:
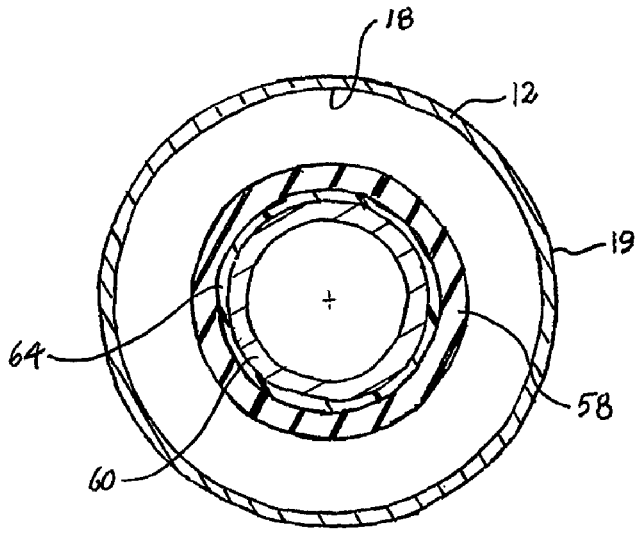
FIG. 8 is an axial cross section of the microwave chamber of FIG. 1 with the mandrel inserted.

The chamber 10 is especially useful for exposing materials 58 wrapped around an elongated member, such as a metal mandrel 60, to microwave energy. The mandrel is supported by and extends through a cover plate 62. The cover plate is sealed to the first end of the chamber. The mandrel extends axially into the chamber. As shown in FIGS. 7 and 8, the material and the mandrel are spaced from the interior wall 18 and the end plate 16 by at least 2.5 cm to minimize arcing to the material or the mandrel. (For lower power levels, the distances can be shortened.) An optional non-metallic spacer 64 may be used to space the material from the mandrel. The first bar 54' and the last bar 54" of the leaky bar waveguides 28 are preferably positioned closer, about 3 cm closer, for example, to the ends of the chamber than is the material on the mandrel. The material may or may not rotate in the chamber, but preferably does for more uniform heating of the material.

The mandrel is maintained cantilevered in the chamber by means of the cover plate, which has a rotatable bearing 66 against which the mandrel bears as it is rotated by a motor (not shown). As the mandrel rotates, the microwave energy emitted through the slots impinges directly on the material being processed. A uniform radiation pattern is maintained in the chamber through the geometry of the chamber and the mandrel and by the mode stirrer, which better distributes the energy throughout the chamber.

Although the invention has been described in detail with respect to a preferred version, other versions are possible. For example, the bars on the leaky waveguide could have cross sections other than circles, such as square, rectangular, or elliptical, with or without rounded edges, or could even be formed as residual strips of the waveguide wall separated by gaps cut in the wall in a pattern providing a selected release of energy. As another example, if more, closely spaced leaky bar waveguides are used to couple microwave energy into the chamber, rotating material that might otherwise have to be rotated to be uniformly heated may not be necessary. So, as these examples suggest, the spirit and scope of the invention is not limited to the example version described in detail.

What is claimed is:

1. Apparatus for exposing materials to microwave energy, the apparatus comprising:

a cylindrical wall extending axially from a first end to a second end and including an interior surface and an exterior surface and defining an axis, the cylindrical wall forming a first elongated slot elongated generally axially along the cylindrical wall and extending through the cylindrical wall from the interior surface to the exterior surface;

an end plate closing off the second end of the cylindrical wall to form a cylindrical chamber;

a first waveguide having a waveguide wall extending in length along a direction of propagation of microwave energy and forming an elongated opening in the waveguide wall along the length of the waveguide;

wherein the first waveguide connects to the exterior surface of the cylindrical chamber with the elongated opening in the waveguide wall in communication with the first elongated slot through which the first waveguide couples microwave energy into the cylindrical chamber.

2. Apparatus as in claim 1 further comprising a second end plate at the first end of the cylindrical wall.

3. Apparatus as in claim 1 wherein the cylindrical wall further forms a second elongated slot between the interior and the exterior surfaces positioned at a circumferentially spaced location from the first elongated slot and wherein the apparatus further comprises a second waveguide forming an elongated opening along its length and connected to the exterior surface of the cylindrical chamber with the elongated opening in communication with the second elongated slot.

4. Apparatus as in claim 3 wherein the first and second elongated slots are formed in the cylindrical wall at diametrically opposed positions.

5. Apparatus as in claim 1 wherein the cylindrical wall forms four elongated slots at 90° circumferential intervals.

6. Apparatus as in claim 1 wherein the elongated slot has a long axis skewed relative to the axis of the cylindrical chamber.

7. Apparatus as in claim 1 further comprising a mode stirrer in the cylindrical chamber at the end plate.

8. Apparatus as in claim 7 wherein the mode stirrer includes a rotatable shaft and a plurality of sector-shaped blades extending from the shaft.

9. Apparatus as in claim 8 wherein at least some of the blades are axially offset from each other.

10. Apparatus as in claim 8 wherein the blades are circumferentially offset from each other.

11. Apparatus as in claim 8 wherein the planes of the blades are parallel to the end plate.

12. Apparatus as in claim 8 wherein the sum of the sectors spanned by all the sector-shaped blades is less than 360°.

13. Apparatus as in claim 1 wherein the first waveguide is rectangular and the waveguide wall comprises a pair of opposite narrow walls and a pair of opposite broad walls and wherein the elongated opening in the first waveguide is formed in one of the narrow walls.

14. Apparatus as in claim 1 further comprising spaced apart parallel bars extending across the elongated opening in the first waveguide.

15. Apparatus as in claim 14 wherein the spacing between consecutive parallel bars is constant.

16. Apparatus as in claim 14 wherein the bars are cylindrical.

17. Apparatus as in claim 1 wherein the first waveguide is disposed at an angle relative to the axis of the cylindrical chamber.

18. Apparatus as in claim 1 further comprising an elongated member covered with material to be exposed to microwave energy and disposed coaxially within the cylindrical chamber.

19. Apparatus as in claim 18 wherein the elongated member is a metal mandrel.

20. Apparatus as in claim 18 wherein the distance between the interior surface of the cylindrical wall and the elongated member is substantially the same throughout the cylindrical chamber.

21. Apparatus as in claim 18 wherein the distance between the interior surface of the cylindrical wall and the elongated member is great enough to eliminate arcing between the interior surface and the elongated member.

22. Apparatus as in claim 18 wherein the distance between the end plate and the elongated member is great enough to eliminate arcing between the end plate and the elongated member.

* * * * *